US010807257B2

(12) United States Patent
Brellis

(10) Patent No.: US 10,807,257 B2
(45) Date of Patent: Oct. 20, 2020

(54) SHAVING HEAD

(71) Applicant: BIC-VIOLEX S.A., Anixi (GR)

(72) Inventor: Christoforos-Athanassios Brellis, Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 15/769,441

(22) PCT Filed: Dec. 16, 2016

(86) PCT No.: PCT/IB2016/057727
§ 371 (c)(1),
(2) Date: Apr. 19, 2018

(87) PCT Pub. No.: WO2017/103884
PCT Pub. Date: Jun. 22, 2017

(65) Prior Publication Data

US 2018/0311846 A1 Nov. 1, 2018

Related U.S. Application Data

(60) Provisional application No. 62/268,628, filed on Dec. 17, 2015.

(51) Int. Cl.
*B26B 21/40* (2006.01)
*B26B 21/44* (2006.01)
(Continued)

(52) U.S. Cl.
CPC ..... *B26B 21/4012* (2013.01); *B26B 21/4025* (2013.01); *B26B 21/443* (2013.01);
(Continued)

(58) Field of Classification Search
CPC . B26B 21/40; B26B 21/4012; B26B 21/4018; B26B 21/4025; B26B 21/4031;
(Continued)

(56) References Cited

U.S. PATENT DOCUMENTS 4,403,412 A * 9/1983 Trotta ..... B26B 21/227 30/47
5,092,042 A * 3/1992 Miller ..... B26B 21/4031 30/34.2
(Continued)

FOREIGN PATENT DOCUMENTS

CN 202702272 U 1/2013
CN 103286798 A 9/2013
(Continued)

OTHER PUBLICATIONS

International Search Report for PCT/IB2016/057727, dated Mar. 31, 2017.
(Continued)

*Primary Examiner* — Andrea L Wellington
*Assistant Examiner* — Richard D Crosby, Jr.
(74) *Attorney, Agent, or Firm* — Polsinelli PC

(57) ABSTRACT

A shaving head includes a housing having a plurality of openings, at least one component coupled with the housing, and at least one retainer coupled with the housing. The retainer secures the at least one component in the housing and is a bar. The retainer is received in the corresponding openings in the housing.

14 Claims, 7 Drawing Sheets

(51) Int. Cl.
*B26B 21/06* (2006.01)
*B26B 21/22* (2006.01)

(52) U.S. Cl.
CPC ..... *B26B 21/06* (2013.01); *B26B 21/225* (2013.01); *B26B 21/4068* (2013.01)

(58) Field of Classification Search
CPC ..... B26B 21/44; B26B 21/443; B26B 21/446; B26B 21/4068; B26B 21/4075
USPC ..... 30/47–51
See application file for complete search history.

(56) References Cited

U.S. PATENT DOCUMENTS 5,251,376 A * 10/1993 Althaus ..... B26B 21/227 30/50
6,035,537 A * 3/2000 Apprille, Jr. ..... B26B 21/227 30/346.5
6,305,084 B1 * 10/2001 Zucker ..... B26B 21/22 30/50
7,200,942 B2 * 4/2007 Richard ..... B26B 21/225 30/526
8,782,903 B2 * 7/2014 Clarke ..... B26B 21/4018 30/34.1
9,539,734 B1 * 1/2017 Bozikis ..... B26B 21/227
9,701,034 B2 * 7/2017 Papadopoulos-Papageorgis ..... B26B 21/222
9,707,688 B2 * 7/2017 Giannopoulos ..... B26B 21/222
9,895,817 B2 * 2/2018 Georgakis ..... B26B 21/222
10,369,711 B2 * 8/2019 Washington ..... B26B 21/227
2003/0208907 A1 * 11/2003 Brown, Jr. ..... B26B 21/222 30/50
2004/0103538 A1 * 6/2004 Dansreau ..... B26B 21/222 30/34.2
2007/0056167 A1 * 3/2007 Richard ..... B26B 21/227 30/50
2015/0314465 A1 * 11/2015 Giannopoulos ..... B26B 21/222 30/532
2018/0311846 A1 * 11/2018 Brellis ..... B26B 21/4025

FOREIGN PATENT DOCUMENTS

GB 2 471 676 A 1/2011
GB 2471676 A 1/2011
GB 2471676 A 9/2012
WO 2011071350 A2 6/2011
WO 2011071350 A2 11/2011
WO 2015082002 A1 6/2015
WO 2015090385 A 6/2015
WO 2015090385 A1 6/2015
WO 2017103884 A1 6/2017

OTHER PUBLICATIONS

Chinese Search Report for Chinese Patent Application No. CN2016800633158, dated Oct. 9, 2019.
Chinese Search Report for Chinese Patent Application No. CN2016800633158, dated May 29, 2020.

* cited by examiner

SHAVING HEAD

CROSS-REFERENCE TO RELATED APPLICATION

This application is a National Stage application of International Application No.: PCT/162016/057727, filed Dec. 16, 2016 which claims benefit to U.S. Provisional Patent Application No. 62/268,628, filed in the U.S. Patent and Trademark Office on Dec. 17, 2015, all of which is incorporated herein by reference in its entirety for all purposes.

BACKGROUND

1. Field

The following description relates to shaving razors. A shaving razor may include a head with one or more blades and a retainer configured to retain components of the shaving head. For example, a shaving razor may include a head with one or more blades which are secured in the head by a retainer bar which is received by the housing of the head.

2. Description of Related Art

Shaving razors include shaving heads which contain components such as shaving blades, lubrication strips, guard bars, covers, and trimming blades. The components in conventional shaving heads would be individually and separately retained within the shaving head. As such, the components would each have separate retaining means; for example, traditional clips may be utilized for each component. However, bending traditional clip legs at multiple locations of the cartridge provides for difficulties in manufacturing while also providing multiple locations for retaining the components and managing the tolerances that are applied.

During the manufacturing process of conventional shaving heads, the clips may encounter buckling as a result of force that is applied during installation of the clips. As a result of a bending force exerted on the clips, the clips have a tendency to buckle upwards. Consequently, blade exposures may be unstable throughout the razor cartridge and may vary significantly from intended blade exposure values. Also, during manufacturing process, clips may fail to be properly installed in a razor housing, which requires additional attention and labor to ensure that the clips are properly installed in the housing.

SUMMARY

The present disclosure provides a shaving razor including a shaving head with a housing and one or more components. The components may be at least one blade, a guard bar, a cap, at least one lubrication strip, or any combination thereof. The components may be partially covered and secured in the housing by at least one retainer. The retainer may be a bar which may be substantially cylindrical. The retainer may further be received in at least one opening formed in the housing.

According to some aspects, the shaving head may include a housing having a plurality of openings, at least one component coupled with the housing, and at least one retainer coupled with the housing. The at least one retainer may secure the at least one component in the housing. The at least one retainer may be a bar and may be received in the corresponding openings in the housing. The at least one component may include at least one blade, a guard bar, a cap, at least one lubrication strip, or a combination thereof. The housing may extend along a longitudinal axis. The housing may have a top side, a bottom side opposite to the top side, first and second longitudinal walls, and first and second side walls. The first and second longitudinal walls may each extend longitudinally along the longitudinal axis between the top and bottom sides. The first and second side walls may each extend between the first and second longitudinal walls. The at least one retainer may be coupled with one of the first and second side walls. The openings in the housing may be through holes, blind holes, part of a cavity in the housing, or a combination thereof. The openings may have a diameter of, for example, about 0.45 mm. The at least one retainer may have a width of about 0.5 mm. However, according to some aspects, the at least one retainer may have a width of, for example, about 0.5 mm to about 1.0 mm. The at least one retainer may have a width of, for example, about 0.5 mm. The at least one retainer may be substantially cylindrical and/or may have a substantially homogenous shape. The openings in the housing may be formed in receptacles. The openings in the housing may have a space such that the openings receive the retainer by snap fitting. The space may have a size of, for example, about 0.43 mm. The at least one retainer may include two ears on each side of the at least one retainer. The ears may be configured to be compressed for insertion in the corresponding openings in the housing. The ears may include a spring which returns the ears, when not compressed, to an original position. The at least one retainer may be secured in the housing above a portion of the at least one component such that the at least one retainer abuts the top of the portion of the at least one component, securing the at least one component within the housing.

According to further aspects, the shaving razor may include a handle and a shaving head coupled with the handle. The shaving head may include a housing having a plurality of openings, at least one component coupled with the housing, and at least one retainer coupled with the housing. The at least one retainer may secure the at least one component in the housing. The at least one retainer may be a bar and may be received in the corresponding openings in the housing.

The foregoing is intended to be illustrative and is not meant in a limiting sense. Many features of the embodiments may be employed with or without reference to other features of any of the embodiments. Additional aspects, advantages, and/or utilities of the present disclosure will be set forth in part in the description that follows and, in part, will be apparent from the description, or may be learned by practice of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain aspects of the present disclosure. It should be understood, however, that the present disclosure is not limited to the precise aspects and features shown. The accompanying drawings, which are incorporated in and constitute a part of this specification, illustrate an implementation of apparatuses consistent with the present disclosure and, together with the description, serve to explain advantages and principles consistent with the present disclosure.

DETAILED DESCRIPTION

Figure 1:
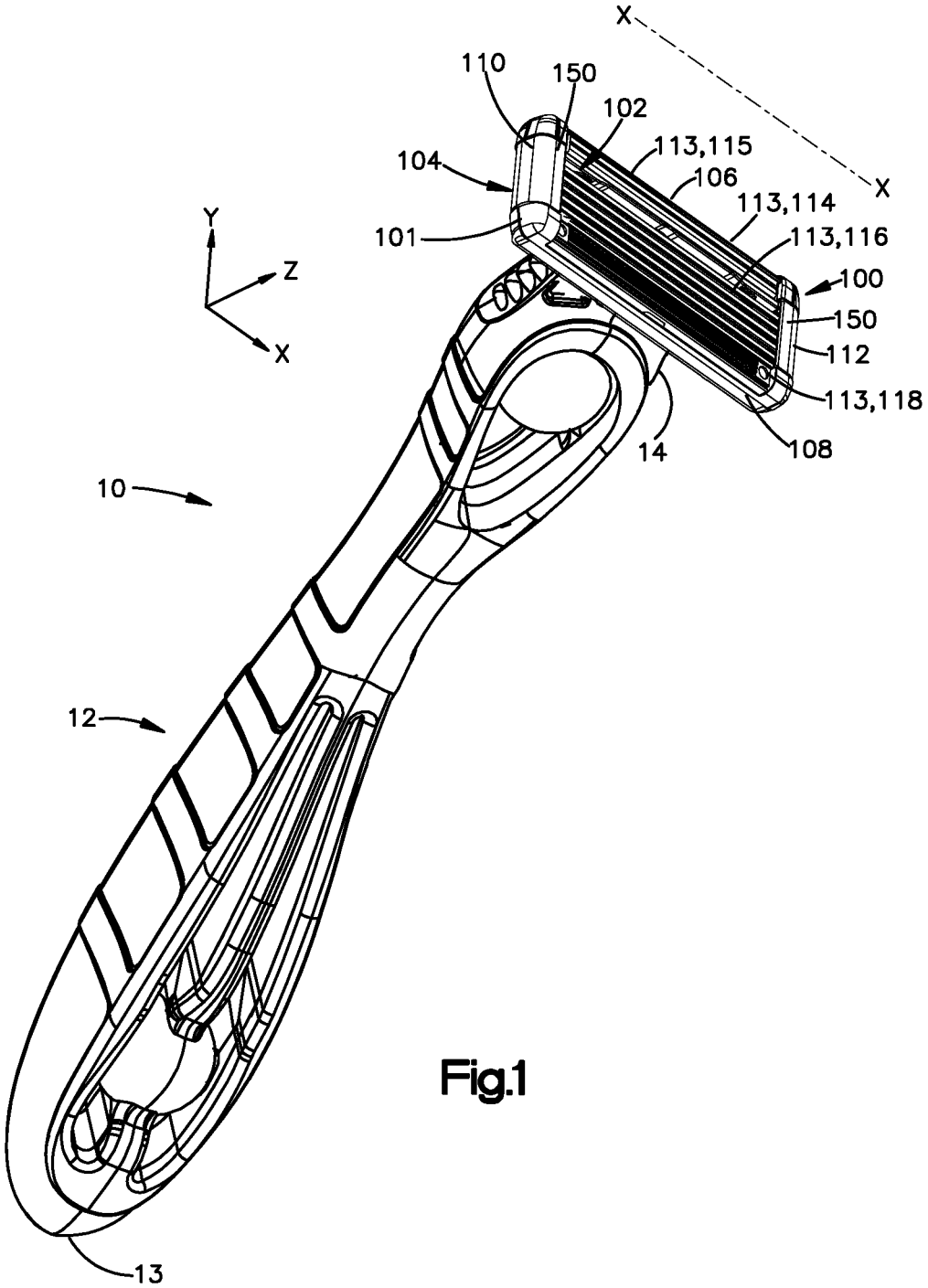
FIG. 1 is a perspective view of a shaving razor with a handle, a shaving head, and retainer.

It is to be understood that the present disclosure is not limited in its application to the details of construction and to the aspects of the components as set forth in the following description or illustrated in the drawings. The figures and written description are provided to teach any person skilled in the art to make and use the inventions for which patent protection is sought. The present disclosure is capable of other aspects and of being practiced and carried out in various ways. Persons of skill in the art will appreciate that the development of an actual commercial embodiment incorporating aspects of the present disclosure will require numerous implementations-specific decisions to achieve the ultimate goal of the developer for the commercial embodiment. While these efforts may be complex and time-consuming, these efforts, nevertheless, would be a routine undertaking for those of skill in the art having the benefit of this disclosure.

I Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top", "bottom", "left", "right", "upper", "lower", "down", "up", and "side", are used in the description for clarity in specific reference to the figures and are not intended to limit the scope of the present disclosure or the appended claims. Further, it should be understood that any one of the features of the present disclosure may be used separately or in combination with other features. Other systems, methods, features, and advantages of the present disclosure will be, or become, apparent to one with skill in the art upon examination of the figures and the detailed description. It is intended that all such additional systems, methods, features, and advantages be included within this description, be within the scope of the present disclosure, and be protected by the accompanying claims.

Further, any term of degree such as, but not limited to, "substantially", as used in the description and the appended claims, should be understood to include an exact, or a similar, but not exact configuration. For example, "a substantially planar surface" means having an exact planar surface or a similar, but not exact planar surface. Similarly, the terms "about" or "approximately", as used in the description and the appended claims, should be understood to include the recited values or a value that is three times greater or one third of the recited values. For example, about 3 mm may include all values from 1 mm to 9 mm, and approximately 50 degrees may include all values from 16.6 degrees to 150 degrees.

Further, as the present disclosure is susceptible to embodiments of many different forms, it is intended that the present disclosure be considered as an example of the principles of the present disclosure and not intended to limit the present disclosure to the specific embodiments shown and described. Any one of the features of the present disclosure may be used separately or in combination with any other feature. References to the terms "embodiment", "embodiments", and/or the like in the description mean that the feature and/or features being referred to are included in, at least, one aspect of the description. Separate references to the terms "embodiment", "embodiments", and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments but is not necessarily included. Thus, the present disclosure may include a variety of combinations and/or integrations of the embodiments described herein. Additionally, all aspects of the present disclosure, as described herein, are not essential for its practice. Likewise, other systems, methods, features, and advantages of the present disclosure will be, or become, apparent to one with skill in the art upon examination of the figures and the description. It is intended that all such additional systems, methods, features, and advantages be included within this description, be within the scope of the present disclosure and be encompassed by the claims.

Lastly, the terms "or" and "and/or," as used herein, are to be interpreted a s inclusive or meaning any one or any combination. Therefore, "A, B or C" or "A, B and/or C" mean any of the following: "A", "B", "C"; "A and B"; "A and C"; "B and C"; "A, B and C". An exception to this definition will occur only when a combination of elements, functions, steps or acts are in some way inherently mutually exclusive.

II. General Architecture

According to some aspects, FIGS. 1-5 details a shaving razor 10 which may include a handle 12 coupled with a shaving head 100. The handle 12 may include a proximal end 13 and a distal end 14 and may extend in a handle direction between the proximal end 13 and the distal end 14. The shaving head 100 may be coupled with the distal end 14 of the handle 12. The shaving head 100 may be removably coupled with the handle 12, for example, by a lock and release mechanism. According to other aspects, the shaving head 100 may be fixedly coupled with the handle 12 such that the shaving head 100 is not configured to be removably coupled with or selectively separated from the handle 12. The shaving head 100 may be operable to pivot relative to the handle 12. According to some aspects, the handle 12 may be secured to the shaving head 100 in a fixed relationship such that shaving head 100 is not operable to pivot relative to the handle 12. The handle 12 may be any suitable shape to allow a user to securely grip the handle 12. The handle 12 may include one continuous curve or include one straight portion or several curved and/or straight portions extending along an entirety of or a substantial portion of the handle 12.

According to further aspects, the shaving head 100 may include a housing 101. The housing 101 may extend along a longitudinal axis X-X. The housing 101 may include a substantially rectangular shape but may be any suitable shape such as ovoid or circular without deviating from the scope of the present disclosure. The shaving head 100 and the housing 101 may include a top side 102 and a bottom side 104 opposite the top side 102. The bottom side 104 may be proximate to the handle 12, and the top side 102 may include at least one skin contacting area. The housing 101 may further include first and second longitudinal walls 106, 108. Each of the first and second longitudinal walls 106, 108 may extend longitudinally along the longitudinal axis X-X between the top and bottom sides 102, 104 and in a direction Z of the housing 101. The first and second longitudinal walls 106, 108 may extend substantially parallel to each other. The shaving head 100 and the housing 101 may include first and second side walls 110, 112 that may extend substantially parallel to each other and between the first and second longitudinal walls 106, 108 along a direction Y of the housing 101. The first and second side walls 110, 112 may also extend between the top and bottom sides 102, 104 along the direction Z of the housing 101. The housing 101 may be further be made of, for example, plastic, metal, another suitable material, or any combination thereof.

The shaving head 100 may further include a plurality of components 113 which may assist, and which may contribute to the shaving experience of the user. One of the components 113 may be a plurality of blades 116 disposed and retained within the housing 101. The blades 116 may extend along the longitudinal axis X-X. According to some aspects, the shaving head 100 can include, for example, one, two, three, four, or more of the blades 116. The blades 116 may be movably disposed or freely mounted, in the housing 101. For example, the blades 116 may be coupled with elastic fingers which extend from the housing 101. According to other aspects, the blades 116 may be fixedly disposed in housing 101.

According to some aspects, the components 113 of the shaving head 100 may also include, for example, a cap 114, a lubricating strip 115, and a guard bar 118 included on and/or retained within the shaving head 100. The cap 114 may be coupled with the first longitudinal wall 106. The lubricating strip 115 may be disposed on the top side 102 of the cap 114 to deliver a friction reduction effect, an anti-irritation effect, and/or provide lubrication after shaving. The guard bar 118 may be coupled with the second longitudinal wall 108 opposite the cap 114 to stretch the skin during shaving or dispense the forces applied to the skin, thereby causing the shaving head 100 to glide across the skin while providing a closer shave. The cap 114, the lubricating strip 115, and the guard bar 118 may each extend along the longitudinal axis X-X. According to further aspects, additional components, such as for example, a cover and/or one or more trimming blades, may also be included on and retained within the shaving head 100.

The components 113 may be retained within or on the shaving head 100 by retainers 150. For example, the retainers 150 may be operable to retain the blades 116, the cap 114, the lubricating strip 115, and the guard bar 118 on or within the shaving head 100. The retainers 150 may retain the components 113 by securely abutting and partially covering (i) a portion of the components 113, such as for example, the lateral sides or sides along the direction X of the components 113, and (ii) the side walls 110, 112 of the housing 101. The retainers 150 may be operable to secure one or more other components within or on the shaving head 100. According to other aspects, any one or more of the components 113 may be secured to the shaving head 100 without the retainers 150, such as for example, by any other well-known securing means.

Figure 2A:
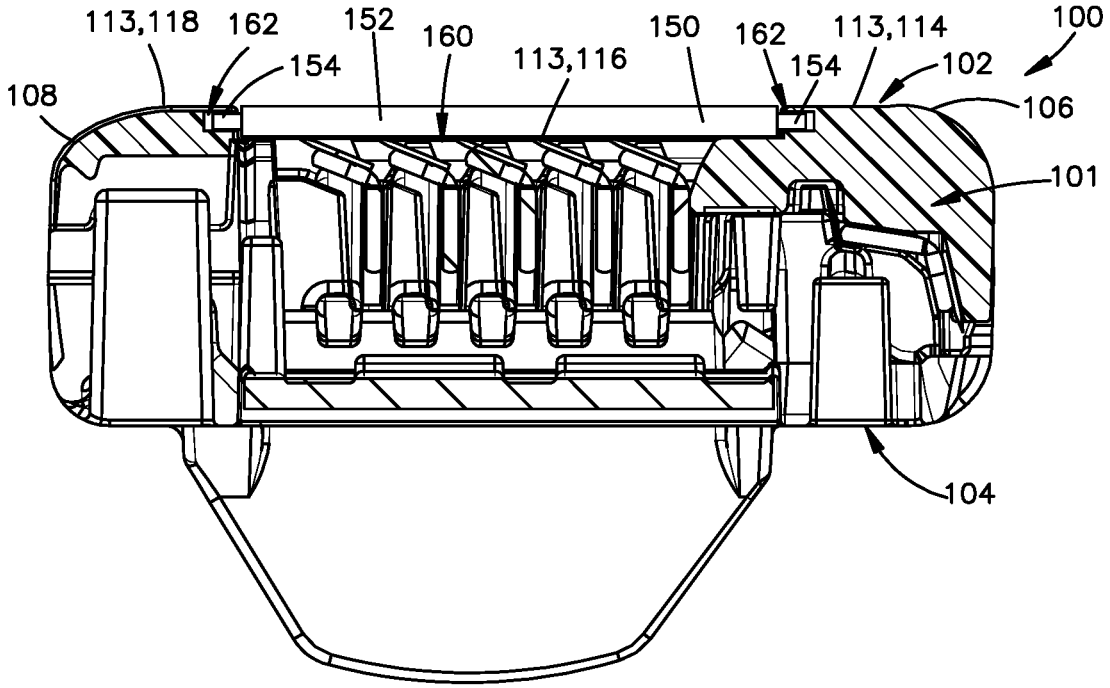
FIG. 2A is a cross-sectional view of the shaving head and retainer of FIG. 1.
Figure 2B:
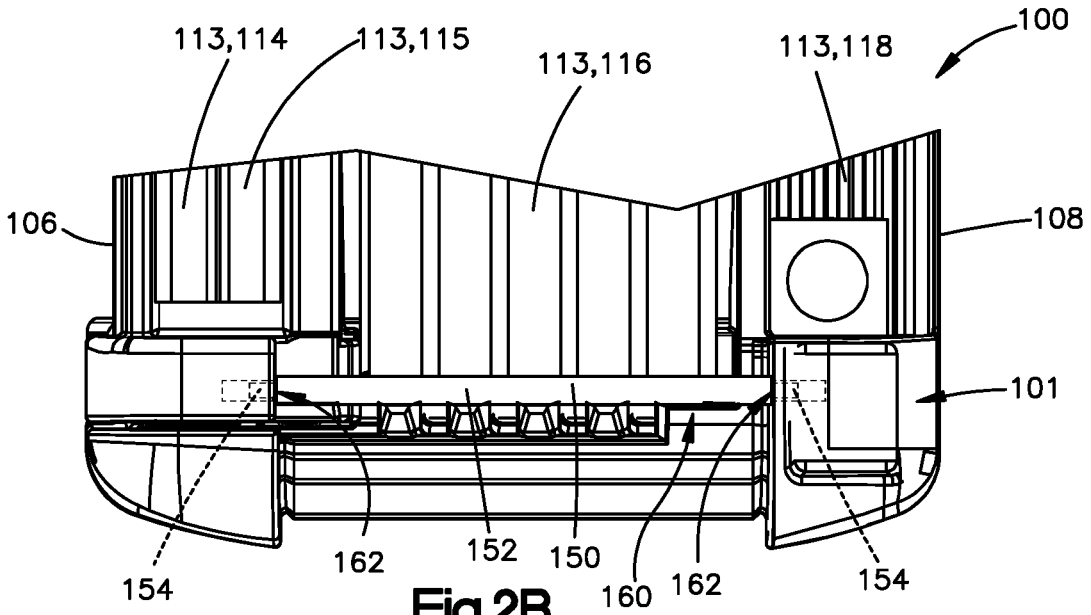
FIG. 2B is a partial top view of the shaving head and retainer of FIG. 2A.

According to some aspects, as shown in FIGS. 2A and 2B, the retainer 150 may include a body 152 and ears 154 on either side of the body 152. According to other aspects, the retainer 150 may have one ear without deviating from the scope of the present disclosure. The retainer 150 may be a bar which is coupled with the housing 101 such that the body 152 of the retainer 150 may be held above and covers a portion of the components 113, including the blades 116. The retainer 150 may be made, for example, of a metal, such as aluminum, but the retainer 150, according to some aspects, may also be made of any suitable material, so long as the material is sufficient to couple with the housing 101 while securely retaining the components 113 in the housing 101. The housing 101 may include a cavity 160 formed therein to receive the retainer 150. The cavity 160 may include openings 162 to receive and retain the ears 154 of the retainer 150. The retainer 150 may be held in place between the top side 102 of the housing 101 and the blades 116, or one or more of the components 113. The cavity 160 may be sized and shaped to correspond with the retainer 150. According to some aspects, the cavity 160 may be as large as desired, so long as the retainer 150 may be received, as the retainer 150 is secured by being between the top side 102 of the housing 101 and the components 113. According to other aspects, the openings 162 may be through holes. As such, the ears 154 may abut the walls of the openings 162thereby securing the retainer 150 in the housing 101. The position of the retainer 150 may correlate to the exposure of the blades 116. As such, the position of the retainer 150 may be adjusted to provide the desired exposure of the blades 116.

Figure 3:
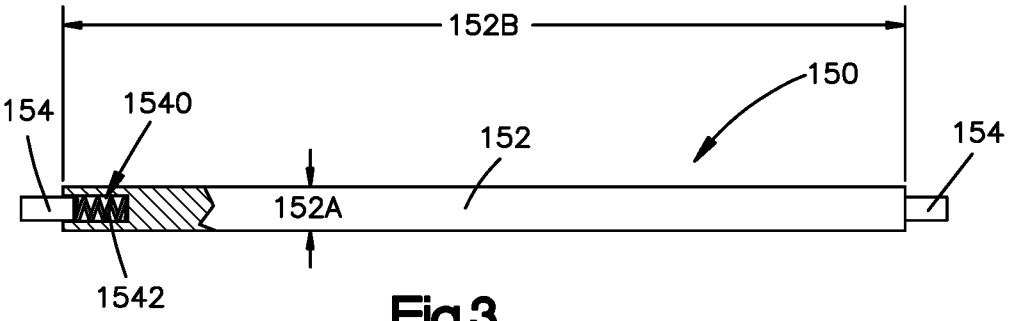
FIG. 3 is a view of the retainer of FIG. 2A
Figure 4:
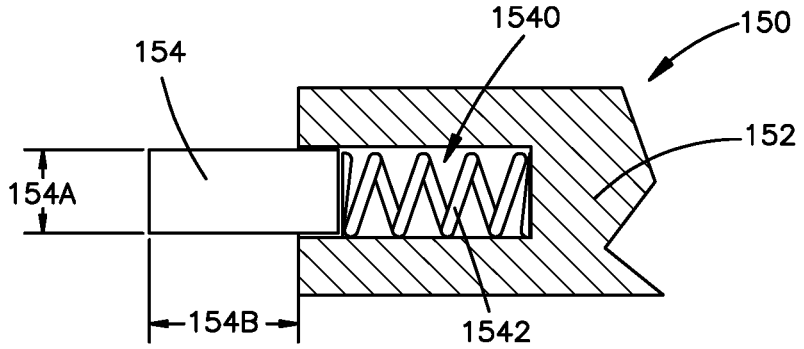
FIG. 4 is an enlarged, partial cross-sectional view of a portion of the retainer of FIG. 3.

According to aspects, as shown in FIGS. 3 and 4, the retainer 150 may be substantially cylindrical, but may also be any suitable shape such as rectangular without deviating from the scope of the present disclosure. The retainer 150 being the shape of a bar may provide for easier manufacturing due to the shape being easily extruded. Also, the retainer 150 may easily be made accurately straight. Further, the stiffness of the shape provides sufficient strength to hold the components 113 within the housing 101. The body 152 of the retainer 150 may have a width 152A of, for example, about 1.0 mm. The width 152A of the retainer 150 may be determined by the diameter of the retainer 150. According to some aspects, the body 152 of the retainer 150 may have a width 152A inclusive of, about, and/or between, for example, 0.5 mm and 1.0 mm. The length 152B of the body 152 of the retainer 150 may be about 9.36 mm, for example. However, according to other aspects, the length 152B of the body 152 of the retainer 150 may be as long as desired or necessary to adequately secure the desired components 113. The ears 154 of the retainer 150 extend from the sides of the body 152. The ears 154 may be substantially cylindrical but may also be any suitable shape such as, for example, rectangular. The ears 154 may be substantially the same shape as the body 152 of the retainer 150, but may also be a different shape than the body 152. For example, the body 152 may be cylindrical while the ears 154 may be rectangular. The ears 154 of the retainer 150 may have a width 154A of about 0.5 mm. However, according to some aspects, the width 154A of the ears 154 may vary as desired. The length 154B of the ears 154 may be about half of the diameter or width 152A of the body 152. As such, the length 154B of the ears 152 may be, for example, about 0.5 mm. Additionally, the length 154B of the ears 154 may also vary as desired.

The ears 154 may be configured to be compressed into the body 152 of the retainer 150. As such, the ears 154 may be received by a recess 1540 that extends into the sides of the body 152. A spring 1542 may also be received in the recess 1540 such that the ears 154 may abut the spring 1542. When the ears 154 are compressed by a force into the body 152, the ears 154 may abut and compress the spring 1542. As such, when the compression force is removed, the spring 1540 may decompress, forcing the ears 154 out from the body 152 of the retainer 150.

According to some aspects, to install the retainer 150, the ears 154 of the retainer 150 may be compressed into the body 152. The retainer 150, with the ears 154 compressed into the body 152, may be inserted into the cavity 160. The compression force may be removed from the ears 154 such that the ears 154 may extend from the body 152. The ears 154 may then abut the housing 101 above, while the body 152 may abut and secure the components 113 below. Between the housing 101 above and the components 113 below, the retainer 150 may be secured in and coupled with the housing 101.

Figure 5:
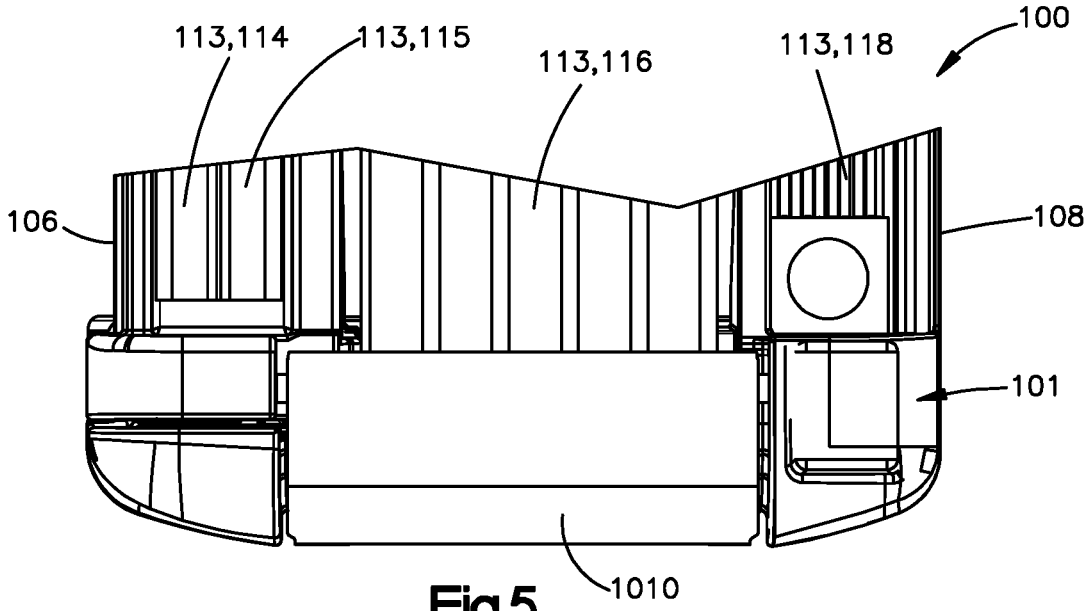
FIG. 5 is a partial top view of shaving head of FIG. 2A with a cover placed thereon.

The retainer 150, according to further aspects, as shown in FIG. 5, may include a cover 1010 coupled to the housing 101. The cover may be provided to hide the retainer 150. The cover 1010 may be snap fitted onto the housing 101. According to some aspects, the cover 1010 may be press fitted, or any other suitable method of coupling the cover 1010 to the housing 101. The cover 1010 may provide aesthetic and safety benefits. For example, the cover 1010 may protect the skin for nicks and cuts by the exposed ends of the blades 116.

Figure 6:
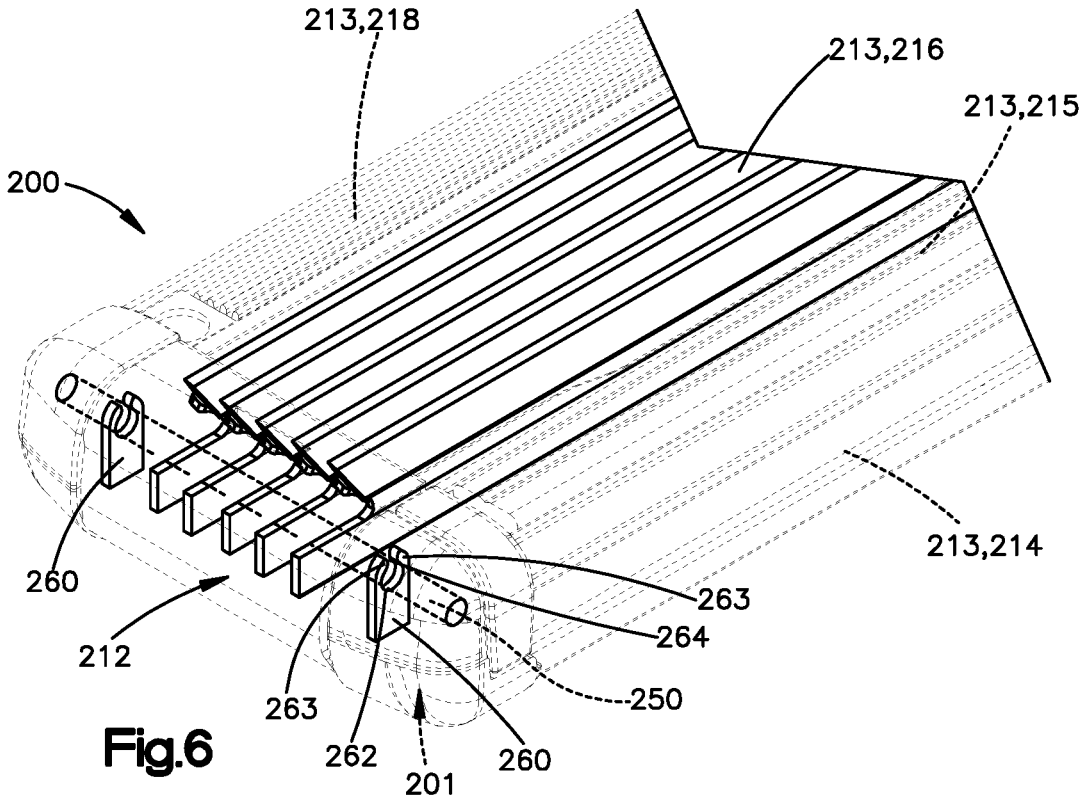
FIG. 6 is a perspective view of another aspect of a shaving head with a retainer.

According to further aspects, as shown in FIG. 6, disclosure a shaving head 200 may include a plurality of components 213 which may assist, and which may contribute to the shaving experience of the user. One of the components 213 may be a plurality of blades 216 disposed and retained within the housing 201. The blades 216 may extend along the longitudinal axis X-X. The shaving head 200 may include, for example, one, two, three, four, or more of the blades 216. The blades 216 may be movably disposed or freely mounted, in the housing 201. For example, the blades 216 may be coupled with elastic fingers which extend from the housing 201. According to other aspects, the blades 216 may be fixedly disposed in the housing 201.

The components 213 of the shaving head 200 may also include a cap 214, a lubricating strip 215, and a guard bar 218 included on and/or retained within the shaving head 200. Additional components, such as for example, a cover and/or one or more trimming blades, may also be included on and retained within the shaving head 100.

According to some aspects, a plurality of the components 213 may be retained within the shaving head 200 by retainers 250. For example, the retainers 250 may be operable to retain the blades 216, the cap 214, the lubricating strip 215, and the guard bar 218 within the shaving head 200. The retainers 250 may be installed in each of the two side walls 212 (the other side wall 210 not shown in the partial view of FIG. 7) of the housing 201. The retainers 250 may be installed in other walls or only one of the side walls of the housing 201. The retainers 250 may retain the components 213 by securely abutting and partially covering (i) a portion of the components 213, such as for example, the lateral sides or sides along the direction X of the components 213, and (ii) the side walls 212 (the other side wall 210 not shown in the partial view of FIG. 7). The retainers 250 may be operable to secure one or more other components 213 within or on the shaving head 200 without deviating from the scope of the present disclosure. According to further aspects, any one or more of the components 213 may be secured to the shaving head 200 without the retainers 250, such as for example, by other well-known securing means.

Figure 7:
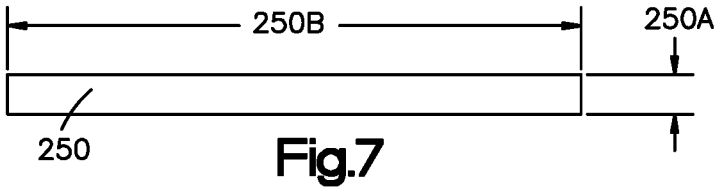
FIG. 7 is a view of the retainer of FIG. 6.

According to some aspects, the retainer 250, in FIGS. 6 and 7, may be a bar with a substantially homogenous shape. The retainer 250 may have a shape that is substantially cylindrical, but may also be any suitable shape such as, for example, rectangular or any other shape. The retainer 250 being the shape of a bar may provide for easier manufacturing due to the shape being easily extruded. For example, if extruded, the shape of the retainer may follow the profile of the die which could be a circle, oval, half circle, polygon or amorphous shaped. If the retainer has a flat surface (for example, a half circle shape), the retainer may have a higher surface contact with each component or blade edge. Also, the retainer 250 may be easily made accurately straight. Further, the stiffness of the shape may provide sufficient strength to hold the components 213 within the housing 201. The retainer 250 may be made, for example, of a metal, such as aluminum. However, according to other aspects, the retainer 250 may be made of any suitable material without deviating from the scope of the present disclosure, so long as the material is sufficient to couple with the housing 201 while securely retaining the components 213 in the housing 201. The retainer 250 may have a width 250A of, for example, about 0.5 mm. The width 250A of the retainer 250 may be determined by the diameter of the retainer 250. According to further aspects, the retainer 250 may have a width 250A inclusive of, about, and/or between, for example, 0.5 mm and 1.0 mm. The length 250B of the retainer 250 may be about 9.36 mm. According to some aspects, the length 250B of the retainer 250 may be as long as desired or necessary to adequately secure the desired components 213.

Figure 8A:
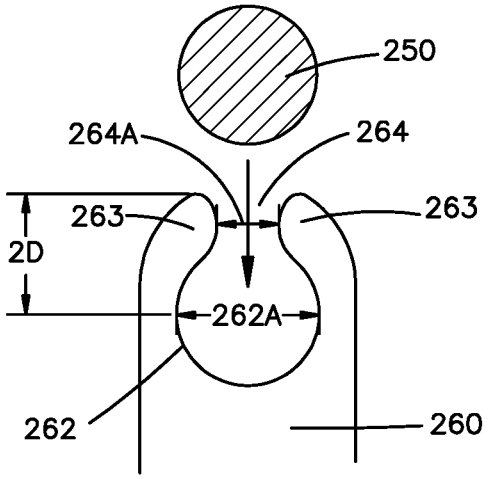
FIGS. 8A-8B detail cross-sectional views of a clip receiving the retainer of FIG. 6.
Figure 8B:
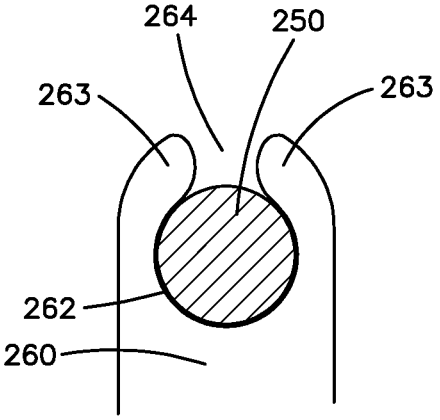

As illustrated in FIGS. 6, 8A, and 8B, the housing 201 may include two receptacles 260 to receive and secure the retainer 250. The figures show only one side of the shaving head 200, but the same or substantially similar configuration may be utilized on the other side of the shaving head 200. While two receptacles 260 may be detailed, less or more receptacles 260 may be utilized to couple the retainer 250 with the housing 201. The receptacles 260 may be located on each side of the blades 216, along a Y direction. According to some aspects, the receptacles 260 may be located on each side and/or in between the blades 216 or any other components 213. The retainer 250, may also be secured and held by the receptacles 260, and may sit above and cover a portion of the components 213 to secure the components 213 within the housing 201. As such, if the components 213 may move upwards, the bottom of the retainer 250 may then abut the top of the portion of the components 213, thereby retaining the components 213 in the housing 201.

The receptacles 260 may include an opening 262. A space 264 may be formed at an entrance to the opening 262. The space 264 may be formed by flanges 263 positioned on either side thereof. The opening 262 may receive the retainer 250 therein. The housing 201 may be made of plastic; and may have a relative elasticity in comparison to the retainer 250. The retainer 250 may be snap fitted and may enter the opening 262. As such, the plastic material of the flanges 263 may have an elasticity which may allow the flanges 263 to expand to allow the retainer 250 to be received therein. When the retainer 250 is received by the opening 262, the flanges 263 may return to their normal shape, holding the retainer 250 tightly within the opening 262. The opening 262 may have a diameter 262A which may be, for example, about 0.05 mm to 0.15 mm smaller than the width 250A, or diameter, of the retainer 250. For example, if the width 250A of the retainer 250 may be about 0.5 mm, the diameter 262A of the opening 262 would be about 0.45 mm. However, according to some aspects, the diameter 262A of the opening 262 may be inclusive of, about, and/or between, for example, 0.45 mm and 0.35 mm. The size 264A of the space 264 of the opening 262 may be slightly narrower than the diameter 262A of the opening 262 to secure the retainer 250 in the opening 262. For example, if the opening 262 may have a diameter 262A of, for example, 0.45 mm, and the size 264A of the space 264 of the opening 262 may be, for example, about 0.43 mm. The center of the opening 262 may be a distance 20 of at least 0.88 mm, for example, from the top of the flanges 263 such that the plastic does not break during assembly or usage.

The shaving head 200 may also include a cover (not labeled in 6, 8A, and 8B) coupled to the housing 201. The cover may be provided to hide the retainer 250. The cover may be snap fitted onto the housing 201. According to some aspects, the cover may be press fitted, or any other suitable method of coupling the cover to the housing 201. The cover may provide aesthetic and safety benefits, such as for example, the cover may protect the skin for nicks and cuts by the exposed ends of the blades 216.

Figure 9A:
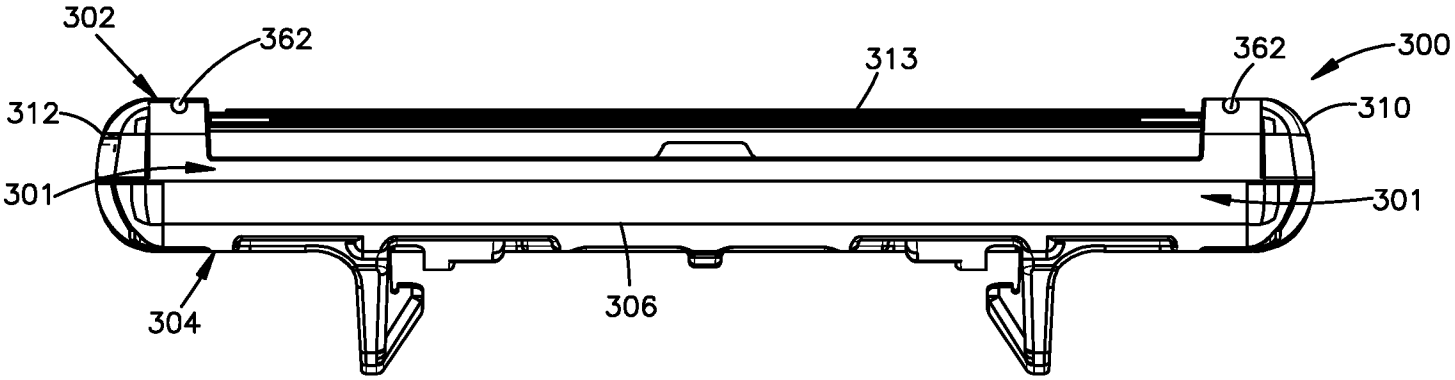
FIGS. 9A-9B detail another aspect of a shaving head.
Figure 9B:
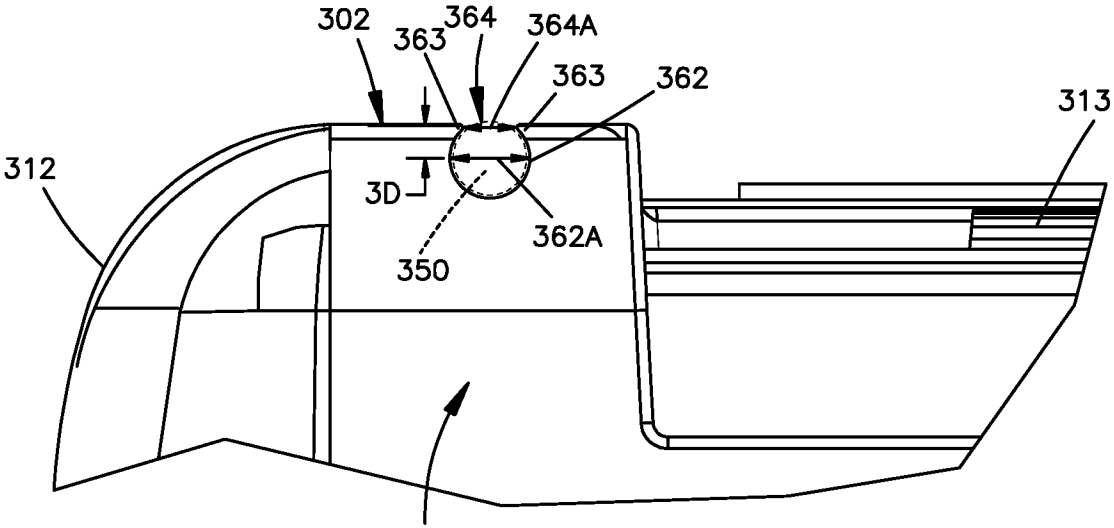

According to further aspects, FIGS. 9A and 9B detail a shaving head 300including a plurality of components 313 which may also assist and contribute to the shaving experience of the user. One of the components 313 may be a plurality of blades (not labeled) disposed and retained within the housing 301. The blades may extend along the longitudinal axis X-X. The shaving head 300 may include, for example, one, two, three, four, or more of the blades without deviating from the scope of the present disclosure. The blades may be movably disposed or freely mounted, in the housing 301. For example, the blades may be coupled with elastic fingers which may extend from the housing 301. According to some aspects, the blades may be fixedly disposed in the housing 301.

The components 313 of the shaving head 300 may also include a cap, a lubricating strip, and a guard bar (all not labeled here) included on and/or retained within the shaving head 300. Additional components, such as for example, a cover and/or one or more trimming blades, may also be included on and retained within the shaving head 300

According to some aspects, a plurality of the components 313 may be retained within the shaving head 300 by retainers 350. For example, the retainers 350 may be operable to retain the blades, the cap, the lubricating strip, and the guard bar within the shaving head 300. The retainers 350 may be installed in each of the two side walls 310, 312 of the housing 301. The retainers 350 may be installed in other walls or only one of the side walls 310, 312 of the housing 301 as desired without deviating from the scope of the present disclosure. The retainers 350 may retain the components 313 by securely abutting and partially covering (i) a portion of the components 313, such as for example, lateral sides or sides along the direction X of the components 313, and (ii) the side walls 310, 312. The retainers 350 may also be operable to secure one or more other components 313 within or on the shaving head 300. According to some aspects, any one or more of the components 313 may be secured to the shaving head 300 without the retainers 350, such as for example, by other well-known securing means.

Similar to FIG. 7, the retainer 350 may be a bar with a substantially homogeneous shape. The retainer 350 may have a shape that is substantially cylindrical; however, the retainer 350 may be any suitable shape such as, for example, rectangular without deviating from the scope of the present disclosure. The retainer 350, being the shape of a bar, may provide for easier manufacturing due to the shape being easily extruded. Also, the retainer 350 may easily be made accurately straight. Further, the stiffness of the shape of the retainer 350 may provide sufficient strength to hold the components 313 within the housing 301. The retainer 350 may be made of a metal, such as for example, aluminum. However, according to some aspects, the retainer 350 may also be made of any suitable material, so long as the material is sufficient to couple with the housing 301 while securely retaining the components 313 in the housing 301. The retainer 350 may have a width of, for example, about 0.5 mm. The width of the retainer 350 may be determined by the diameter of the retainer 350. According to some aspects, the retainer 350 may have a width inclusive of, about, and/or between, for example, 0.5 mm and 1.0 mm. The length of the retainer 350 may be, for example, about 9.36 mm. According to other aspects, the length of the retainer 350 may be as long as desired or necessary to adequately secure the desired components 313.

As illustrated in FIGS. 9A and 9B, the housing 301 may further include openings 362 to receive and secure the retainer 350. The openings 362 may be formed along the top side 302 of housing 301. While FIGS. 9A and 9B illustrate the openings 362 on one side of the housing 301, the housing 301 may also have openings 362 on the opposite side of the housing 301 along the direction Y. The openings 362 may be through holes, but may also be blind holes. Further, the holes 362 in the first and second side walls 310, 312 may be identical, but any combination of through holes or blind holes may be utilized to securely couple the retainer 350 in the housing 301. The retainer 350, secured and held by the 362, may sit above and may cover a portion of the components 313 to secure the components 313 within the housing 301. As such, if the components 313 move upwards, the bottom of the retainer 350 may abut the top of the portion of the components 313, thereby retaining the components 313 in the housing 301.

According to some embodiments, a space 364 may be formed at an entrance to the opening 362. The space 364 may be may be formed by flanges 363 on either side of the space 364 thereof. The top of the flanges 363 may be formed by the top side 302 of the housing 301. The opening 362 may receive the retainer 350 by snap fitting. The housing 301 may be made of plastic and may have a relative elasticity in comparison to the retainer 350. As such, as the retainer 350 enters the opening 362 from above, the plastic material of the flanges 363 may expand to allow the retainer 350 to enter. When the retainer 350 is received by the opening 362, the flanges 363 may return to their normal shape, holding the retainer 350 tightly within the opening 362. The opening 362 may have a diameter 362A which may be, for example, about 0.05 mm to 0.15 mm smaller than the width, or diameter, of the retainer 350. For example, if the width of the retainer 350 is about 0.5 mm, the diameter 362A of the opening 362 would be about 0.45 mm, but may be inclusive of, about, and/or between 0.45 mm and 0.35 mm. The size 364A of the space 364 of the opening 362 may be slightly narrower than the diameter 362A of the opening 362 to secure the retainer 350 in the opening 362. For example, if the opening 362 has a diameter 362A of 0.45 mm, the size 364A of the space 364 of the opening 362 may be about 0.43 mm. Also, the center of the opening 362 may have a distance 30 of, for example, at least 0.88 mm from the top of the flanges 363 such that the plastic does not break during assembly or usage.

Similar to FIG. 5, a cover (not labeled in FIGS. 9A and 9B) coupled to the housing 301 may be provided to hide the retainer 350. The cover may be snap fitted onto the housing 301. While the cover may be press fitted, any other suitable method of coupling the cover to the housing 201. The cover may provide aesthetic and safety benefits. For example, the cover may protect the skin for nicks and cuts by the exposed ends of the blades 216.

Figure 10A:
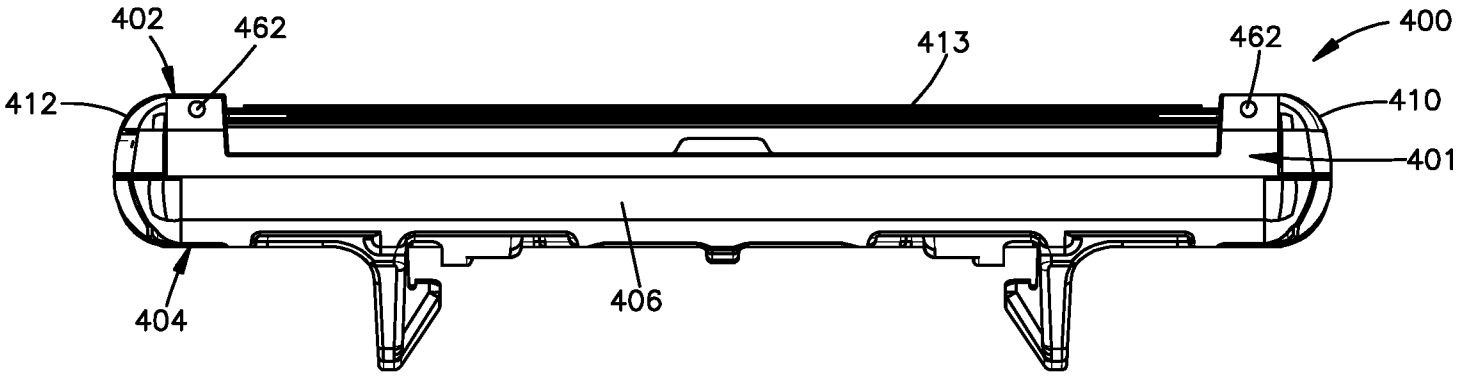
FIGS. 10A-10B detail another aspect of a shaving head
Figure 10B:
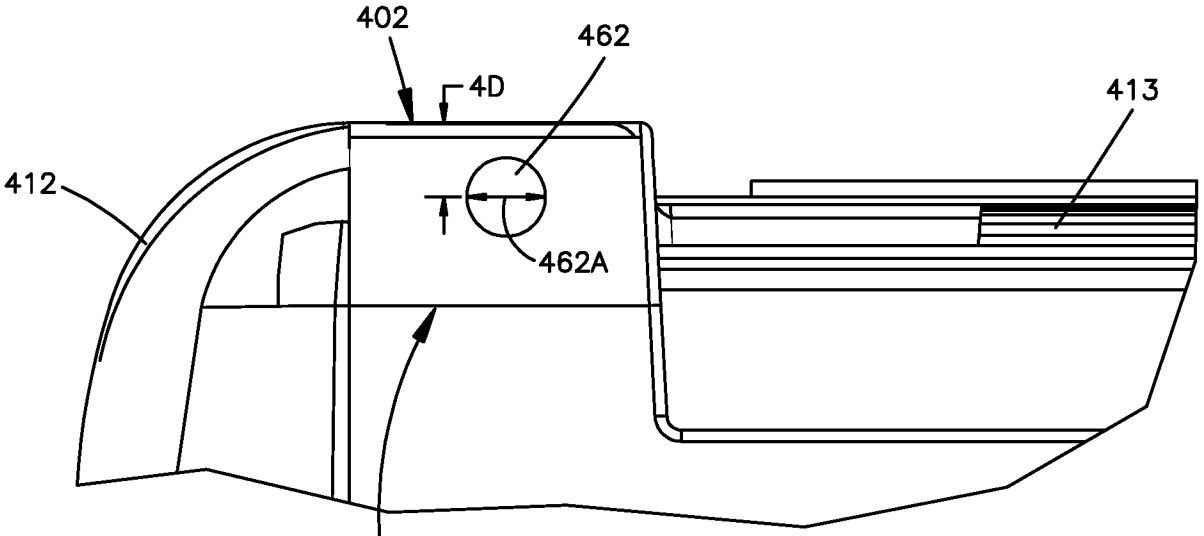

According to other aspects, FIGS. 10A and 10B details a shaving head 400 including a plurality of components 413 which may assist and contribute to the shaving experience of the user. One of the components 413 may be a plurality of blades (not labeled) disposed and retained within the housing 401. The blades may extend along the longitudinal axis X-X. According to some aspects, the shaving head 400 may include, for example, one, two, three, four, or more of the blades without deviating from the scope of the present disclosure. The blades may be movably disposed or freely mounted, in the housing 401. For example, the blades may be coupled with elastic fingers which extend from the housing 401. According to other aspects, the blades may be fixedly disposed in the housing 401.

The components 413 of the shaving head 400 may also include a cap, a lubricating strip, and a guard bar (all not labeled here) included on and/or retained within the shaving head 400. Additional components, such as for example, a cover and/or one or more trimming blades, may also be included on and retained within the shaving head 400 without.

A plurality of the components 413 may be retained within the shaving head 400 by retainers 450. For example, the retainers 450 may be operable to retain the blades, the cap, the lubricating strip, and the guard bar within the shaving head 400. The retainers 450 may be installed in each of the two side walls 410, 412 of the housing 401. According to some aspects, the retainers 450 may be installed in other walls or only one of the side walls of the housing 401 as desired without deviating from the scope of the present disclosure. As illustrated, the retainers 450 may retain the components 413 by securely abutting and partially covering (i) a portion of the components 413, such as for example, lateral sides or sides along the direction X of the components 413, and (ii) the side walls 410, 412. The retainers 450 may also be operable to secure one or more other components 413 within or on the shaving head 400. According to some aspects, any one or more of the components 413 may be secured to the shaving head 400 without the retainers 450, such as for example, by any other well-known securing means.

Similar to FIG. 7, the retainer may be a bar with a substantially homogenous shape. The retainer 450 may have a shape that is substantially cylindrical, but according to some aspects, the retainer 450 may be any suitable shape such as rectangular without deviating from the scope of the present disclosure. The retainer 450 being the shape of a bar may provide for easier manufacturing due to the shape being easily extruded. Also, the retainer 450 can easily be made accurately straight. Further, the stiffness of the shape of the retainer 450 may provide sufficient strength to hold the components 413 within the housing 401. The retainer 450 may be made of a metal, such as for example aluminum, but according to some aspects, the retainer 450 may be made of any suitable material, so long as the material is sufficient to couple with the housing 401 while securely retaining the components 413 in the housing 401. The retainer 450 may have a width of, for example, about 0.5 mm. The width of the retainer 450 may be determined by the diameter of the retainer 450. According to some aspects, the retainer 450 may have a width inclusive of, about, and/or between 0.5 mm and 1.0 mm, for example. The length of the retainer 450 may be, for example, about 9.36 mm. According to other aspects, the length of the retainer 450 may be as long as desired or necessary to adequately secure the desired components 413.

As illustrated in FIGS. 10A and 10B, the housing 401 may include openings 462 to receive and secure the retainer. The openings 462 may be formed proximate to the top side 402 of the housing 401. The openings 462 may be formed in the housing 401 in any location such that, when a retainer 450 is received, the retainer 450 may be securely coupled the components 413 within the housing 401. While FIGS. 10A and 10B illustrate the openings 462 on one side of the housing 401, according to other aspects, the housing 401 may also have openings 462 on the opposite side of the housing 401 along the direction Y. The openings 462, may be, for example, through holes, but one of the corresponding openings 462 on either side of the housing 401 in the Y direction may be blind holes. Further, the openings 462 in the first and second side walls 410, 412 may be identical, but any combination of through holes or blind holes may be utilized to securely couple the retainer 450 in the housing 401. The retainer 450, secured and held by the openings 462, may sit above and may cover a portion of the components 413 to secure the components 413 within the housing 401. As such, if the components 413 move upwards, the bottom of the retainer 450 may abut the top of the portion of the components 413, thereby retaining the components 413 in the housing 401. The openings 462 may be received in the housing 401 at a height, in relation to the housing 401, that would allow the retainer 450 to be located at a desired position and ensure that the blades have the desired exposure.

The openings 462 may be closed holes, such as for example circular, but may also be any suitable shape to correspond with and receive the retainer 450 therein. The opening 462 may have a diameter 462A which may be, for example, about 0.05 mm to 0.15 mm smaller than the width, or diameter, of the retainer 450. As such, if the width of the retainer 450 is about 0.5 mm, the diameter 462A of the opening 462 would be about 0.45 mm, but may be inclusive of, about, and/or between 0.45 mm and 0.35 mm. Also, the center of the opening 462 may be a distance 4D of at least 0.88 mm, for example, from the top of the housing 401 such that the plastic does not break during assembly or usage.

According to some aspects, the retainer 450 may also be inserted into the housing 401 through the opening 462 in a Y direction. The opposite opening 462 in the Y direction may be a blind hole. As such, the retainer 450 may be secured in place by friction fit between the housing 401, the blind hole 462, and the components 413. Other methods of securing the retainer 450 within the housing 401 after being inserted through the opening 462 may be utilized without deviating from the scope of the present disclosure, so long as the retainer 450 may be securely coupled and held in the housing 401 while also securing the components 413 within the housing 401.

Similar to FIG. 5, a cover (not labeled in FIGS. 10A and 10B) coupled to the housing 401 may be provided to hide the retainer 450. The cover may be snap fitted onto the housing 401. According to some aspects, the cover may be press fitted, or any other suitable method of coupling the cover to the housing 401. The cover may provide aesthetic and safety benefits. For example, the cover may protect the skin for nicks and cuts by the exposed ends of the blades 416.

Figure 11:
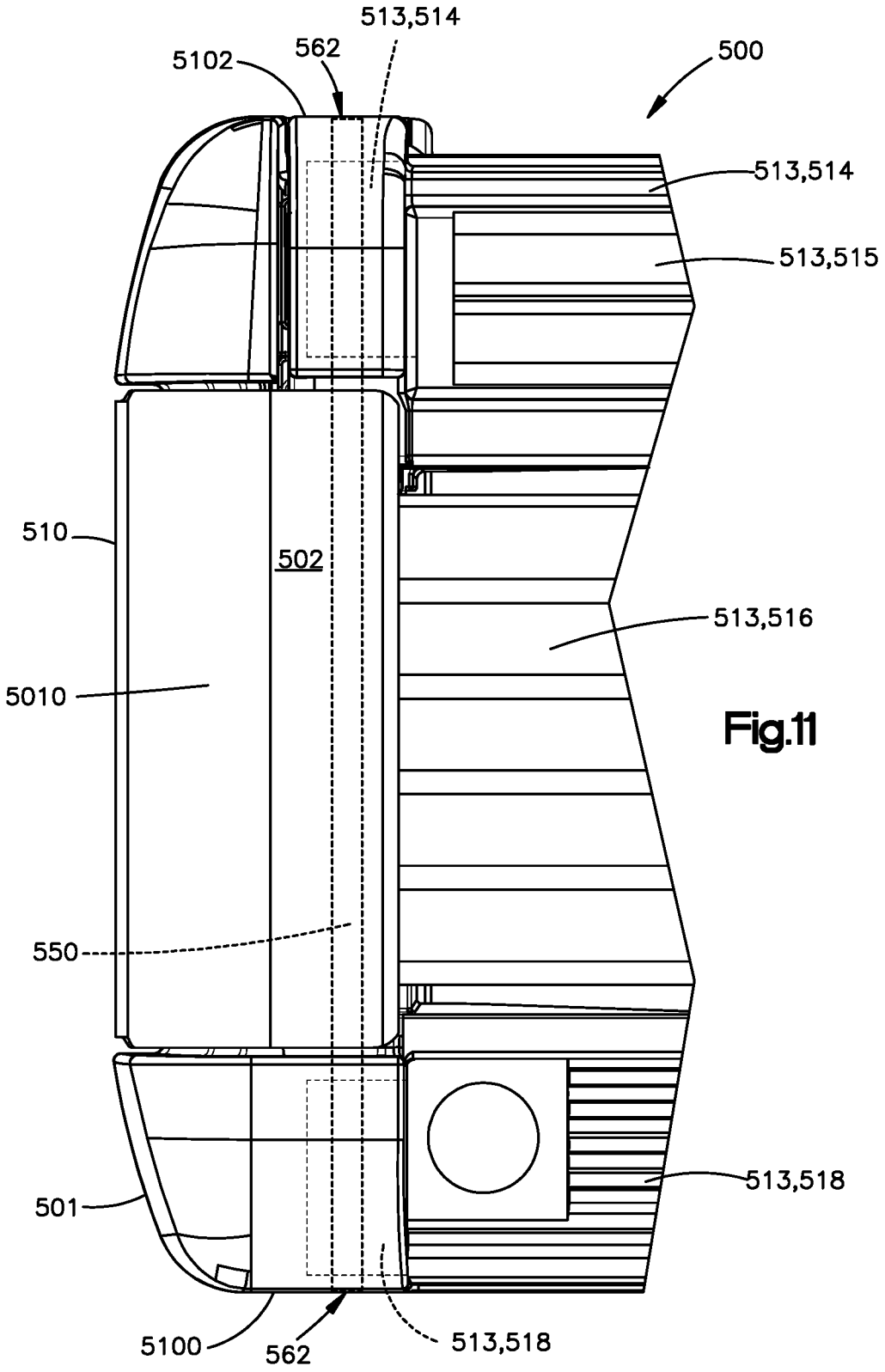
FIG. 11 is yet another aspect of a shaving head

According to further aspects, as detailed in FIG. 11, a shaving head 500 may include a plurality of components 513 which may assist, and which may contribute to the shaving experience of the user. One of the components 513 may be a plurality of blades 516 disposed and retained within the housing 501. The blades 516 may extend along the longitudinal axis X-X. According to some aspects, the shaving head 500 may include, for example, one, two, three, four, or more of the blades 516 without deviating from the scope of the present disclosure. The blades 516 may be movably disposed or freely mounted, in the housing 501.

The components 513 of the shaving head 500 may also include a cap 514, a lubricating strip 515, and a guard bar 518 included on and/or retained within the shaving head 500. Additional components, such as for example, a cover and/or one or more trimming blades, may also be included on and retained within the shaving head 500.

A plurality of the components 513 may be retained within the shaving head 500 by retainers 550. For example, the retainers 550 maybe operable to retain the blades 516, the cap 514, the lubricating strip 515, and the guard bar 518 within the shaving head 500. The retainers 550 may be installed in each of the two side walls 510 of the housing 501. According to some aspects, the retainers 550 may be installed in other walls or only one of the side walls of the housing 501. As illustrated, the retainers 550 may retain the components 513 by securely abutting and partially covering (i) a portion of the components 513, such as for example, lateral sides or sides along the direction X of the components 513, and (ii) the side walls 510. The retainers 550 may be operable to secure one or more other components 513 within or on the shaving head 500. According to other embodiments, any one or more of the components 513 may be secured to the shaving head 500 without the retainers 550, such as for example, by any other well-known securing means, without deviating from the scope of the present disclosure.

Similar to FIG. 7, the retainer 550 may also be a bar with a substantially homogeneous shape. The retainer 550 may have a shape that is substantially cylindrical, but according to some aspects, the retainer 550 may be any suitable shape such as rectangular. The retainer 550, being the shape of a bar, may provide for easier manufacturing due to the shape being easily extruded. Also, the retainer 550 may easily be made accurately straight. Further, the stiffness of the shape of the retainer 550 may provide sufficient strength to hold the components 513 within the housing 501. The retainer 550 may be made of a metal, such as for example aluminum. However, according to other aspects, the retainer 550 may be made of any suitable material, so long as the material is sufficient to couple with the housing 501 while securely retaining the components 513 in the housing 501. The retainer 550 may have a width of about 0.5 mm. The width of the retainer 550 may be determined by the diameter of the retainer 550. According to some aspects, the retainer 550 may have a width inclusive of, about, and/or between 0.5 mm and 1.0 mm, for example. The retainer 550 may cover a portion of all of the components 513. The retainer 550 may span the entire side wall 510 of the shaving head 500 in the Y direction. The length of the retainer 550 may be as long as desired or necessary to adequately secure the desired components 513.

The housing 501 may also include openings 562 to receive and secure the retainer 550. The openings 562 may be formed proximate to the top side 502 of the housing 501. The openings 562 may be formed in the housing 501 in any location such that, when a retainer 550 is received, the retainer 550 may be securely couple the components 513 within the housing 501. The openings 562 may have corresponding openings 562 on the other side of the housing 501 along the Y direction. According to some aspects, the openings 562 may be through holes, but one of the corresponding openings 562 on either side of the housing 501 in the Y direction may be blind holes. Further, the openings 562 in the first 510 and second side walls (not shown) may be identical, but any combination of through holes or blind holes may be utilized to securely couple the retainer 550 in the housing 501. The retainer 550, secured and held by the 562, may sit above and may cover a portion of the components 513 to secure the components 513 within the housing 501. As such, if the components 513 move upwards, the bottom of the retainer 550 may abut the top of the portion of the components 513, thereby retaining the components 513 in the housing 501.

The openings 562, similar to FIGS. 10A and 10B, may also be closed holes. The openings 562 may be circular; however, the openings 562 can be any suitable shape to correspond with and receive the retainer 550. The opening 562 may have a diameter which is about 0.05 mm to 0.15 mm smaller than the width, or diameter, of the retainer 550. For example, if the width of the retainer 550 is about 0.5 mm, the diameter of the opening 562 would be about 0.45 mm, but may be inclusive of, about, and/or between 0.45 mm and 0.35 mm. Also, the center of the opening 562 may be a distance of at least 0.88 mm from the top of the housing 501, for example, such that the plastic does not break during assembly or usage. According to other aspects, the openings 562 may be open holes similar to those illustrated in FIGS. 6-8A or 9A-9B without deviating from the scope of the present disclosure. Further, any combination of openings, such as those as illustrated in FIGS. 6-8A, 9A-9B, 10A-10B, may be utilized.

The retainer 550 may be inserted into the housing 501 through the opening 562 in a Y direction. The opposite opening 562 in the Y direction may be another through hole. According to some aspects, the retainer 550 may extend, for example about 1 mm, from either side 5100, 5102 of the housing 501 outside of the openings 562. The extended parts of the retainer 550 may be bent to secure the retainer 550 within the housing 501. However, the portion of the retainer 550 within the housing 501 may sit above and may secure the components 513 within the housing 501. According to other aspects, the opposite opening 562 in the Y direction may be a blind hole. As such, the retainer 550 may be secured in place by friction fit between the housing 501, the blind hole 562, and the components 513. Other methods of securing the retainer 550 within the housing 501 after being inserted through the opening 562 may be utilized without deviating from the scope of the present disclosure, so long as the retainer 550 is securely coupled and held in the housing 501 while also securing the components 513 within the housing 501.

According to some aspects, a cover 5010 coupled to the housing 501 may be provided to hide the retainer 550. The cover 5010 may be snap fitted onto the housing 501. However, the cover 5010 may also be press fitted, or any other suitable method of coupling the cover to the housing 501. The cover 5010 may provide aesthetic and safety benefits. For example, the cover 5010 may protect the skin for nicks and cuts by the exposed ends of the blades 516. The retainer 550 may be inserted from one side (either side 5100 or side 5102) while the cover 5010 is already assembled. According to other aspects, when the cover 5010 may not be utilized, the area where the cover 5010 would be may be injection molded and integral with the housing 501.

One of ordinary skill in the art will recognize that the described examples are not limited to any particular size or configuration. Any combination of retainer, e.g., any one or more of the retainers 150, 250, 350, 450, 550, may be combined with any type of opening, e.g., any one or more of the openings 162, 262, 362, 462, 562, within the housing, e.g., any one or more of the housing 101, 201, 301, 401, 501. For example, the housing may include two retainers on either lateral side of the components. As such, a first retainer may be coupled with a first side wall while a second retainer coupled with a second side wall. The first retainer may correspond to the retainer 150 while the second retainer may correspond to retainer 350, so long as the components are securely retained and coupled in the housing by the retainer. Further, any number of retainers may be used as desired. One skilled in the art will recognize that different diameters, types, and thicknesses of materials can be utilized when taking into consideration design and stability considerations. A number of manufacturing techniques may be used such as the machining, molding, or casting one or more components of the retainer.

It will be appreciated by those skilled in the art that changes could be made to the aspects described above without departing from the broad disclosure thereof. It is understood, therefore, that the present disclosure herein is not limited to the particular aspects disclosed and is intended to cover modifications within the spirit and scope of the present disclosure.

What is claimed is:

1. A head for a shaving razor, the head comprising:

a housing including a plurality of openings;

at least one component coupled to the housing, the at least one component having a cutting edge; and at least one retainer coupled to the housing, the at least one retainer being a bar and being received in a corresponding one of the plurality of openings formed in the housing such that the at least one retainer is positioned above and partially covering the cutting edge of the at least one component to secure the at least one component in the housing, wherein the retainer includes a pair of ears disposed at opposing ends of the bar, the pair of ears abuts with a respective pair of springs, the springs are configured to be compressed into the bar.

2. The head of claim 1, wherein the at least one component includes at least one blade.

3. The head of claim 2, further comprising a guard bar, a cap, at least one lubrication strip, or a combination thereof.

4. The head of claim 1, wherein the housing, extending along a longitudinal axis, includes a top side; a bottom side opposite to the top side; first and second longitudinal walls, each extending longitudinally along the longitudinal axis between the top and bottom sides; and first and second side walls, each extending between the first and second longitudinal walls; and the at least one retainer is coupled to one of the first and second side walls.

5. The head of claim 1, wherein the plurality of openings in the housing are through holes, blind holes, part of a cavity in the housing, or any combination thereof.

6. The head of claim 1, wherein the plurality of openings has a diameter of about 0.45 mm.

7. The head of claim 1, wherein the at least one retainer has a width of about 0.5 mm to about 1.0 mm.

8. The head of claim 1, wherein the at least one retainer has a width of about 0.5 mm.

9. The head of claim 1, wherein the bar is cylindrical.

10. The head of claim 1, wherein the at least one retainer has a cylindrical shape.

11. The head of claim 1, wherein the openings in the housing are formed in receptacles.

12. The head of claim 1, wherein the openings in the housing have a space such that the openings receive the retainer by snap fitting.

13. The head of claim 12, wherein the space has a size of about 0.43 mm.

14. The head of claim 1, wherein the at least one retainer is secured in the housing above a portion of the at least one component such that the at least one retainer abuts a top of the portion of the at least one component, securing the at least one component within the housing.

* * * * *